US012391354B2

(12) United States Patent
Jaksche

(10) Patent No.: US 12,391,354 B2
(45) Date of Patent: Aug. 19, 2025

(54) LINING FOR VESSEL DRIVES

(71) Applicant: Jaksche Kunststofftechnik GmbH, St. Andrae (AT)

(72) Inventor: Franz Jaksche, St. Stefan (AT)

(73) Assignee: JAKSCHE KUNSTSTOFFTECHNIK GMBH, St. Andrae (AT)

( * ) Notice: Subject to any disclaimer, the term of this patent is extended or adjusted under 35 U.S.C. 154(b) by 364 days.

(21) Appl. No.: 18/110,249

(22) Filed: Feb. 15, 2023

(65) Prior Publication Data

US 2024/0270364 A1 Aug. 15, 2024

(30) Foreign Application Priority Data

Jan. 31, 2022 (AT) ..... A 50043/2022

(51) Int. Cl.
*B63H 20/36* (2006.01)
*B63B 17/00* (2006.01)

(52) U.S. Cl.
CPC ..... *B63H 20/36* (2013.01); *B63B 2017/0045* (2013.01)

(58) Field of Classification Search
CPC ..... B63H 20/36; B63H 5/165; B63H 5/16; B63B 2017/0045; B63B 59/045; B63B 59/04
See application file for complete search history.

(56) References Cited

U.S. PATENT DOCUMENTS 3,870,875 A * 3/1975 Altimus ..... B60Q 1/30 362/477
4,998,496 A * 3/1991 Shaw, III ..... B63H 20/36 150/157
5,148,777 A * 9/1992 Brockhurst ..... B63H 20/36 123/41.15
5,791,955 A * 8/1998 Rinck ..... B63H 20/36 416/247 A
2006/0089061 A1 4/2006 Hutchings
(Continued)

FOREIGN PATENT DOCUMENTS

AU 1169288 8/1988
CA 2 219 750 A1 4/1999
(Continued)

OTHER PUBLICATIONS

Search Report issued in European Patent Application No. 23153436.3 dated Jul. 5, 2023.
(Continued)

*Primary Examiner* — Andrew Polay
(74) *Attorney, Agent, or Firm* — NIXON & VANDERHYE

(57) ABSTRACT

Disclosed is a lining for drives, such as sterndrives, of vessels has a housing that consists of two housing halves. The housing is secured on an adapter plate fastened to the vessel. A seal is provided between the housing halves. A seal that can be expanded by compressed air is arranged between the housing and the adapter plate. The housing halves are connected to one another by use of tension locks. The housing is secured on the adapter plate by use of tension locks. In the housing, a float-controlled bilge pump, from which a line leads to an opening provided in the upper area of the housing, is provided below.

21 Claims, 6 Drawing Sheets

(56) References Cited

U.S. PATENT DOCUMENTS

| | | | | |
|---|---|---|---|---|
| 2007/0227435 | A1* | 10/2007 | Herold | B63H 20/36 114/361 |
| 2008/0020657 | A1* | 1/2008 | Williams | B63H 20/36 440/71 |
| 2021/0380214 | A1* | 12/2021 | Sjöblom | B63H 20/36 |

FOREIGN PATENT DOCUMENTS

| | | | | |
|---|---|---|---|---|
| DE | 10 2004 004 715 | | 9/2005 | |
| FR | 2 743 349 | | 7/1997 | |
| FR | 2743349 | A1 * | 7/1997 | B63B 59/045 |
| FR | 2 826 929 | | 1/2003 | |
| FR | 2826929 | A1 * | 1/2003 | B63H 20/36 |
| FR | 2 977 859 | | 7/2011 | |
| WO | 2005/105567 | | 11/2005 | |
| WO | 2005/105567 | A1 | 11/2005 | |
| WO | 2020/094231 | | 5/2020 | |

OTHER PUBLICATIONS

Austrian Search Report for A 50043/2022, dated Jan. 31, 2022, 4 pages.

* cited by examiner

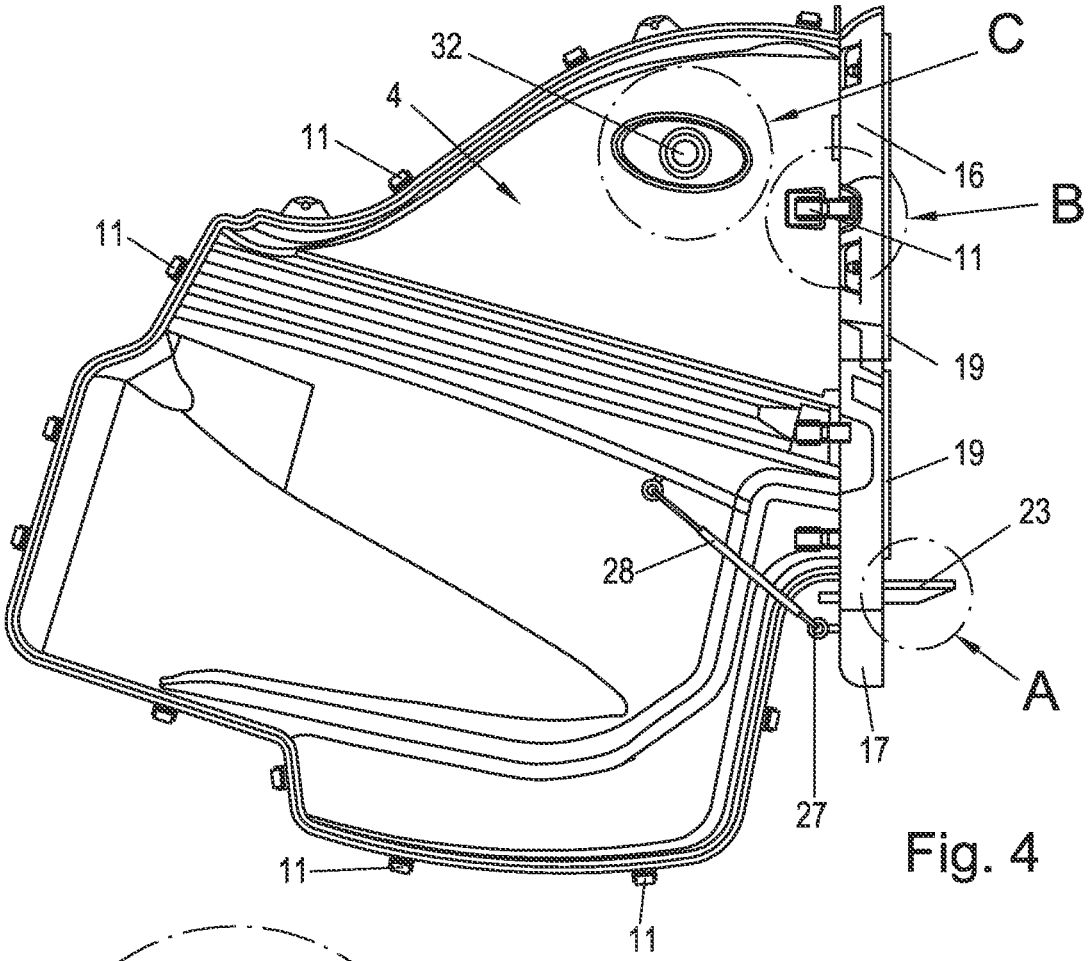
Fig. 4
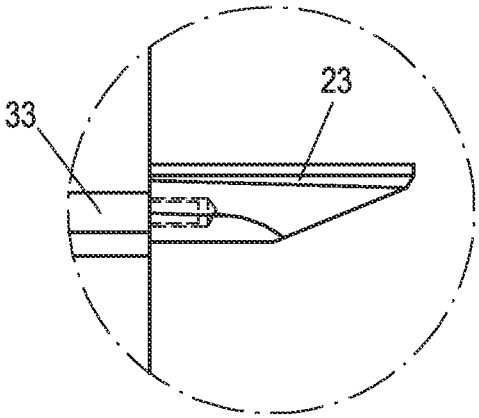
Detail A
Detail B
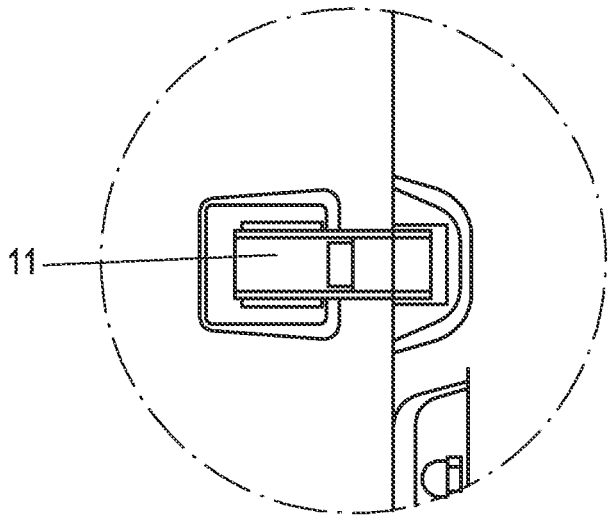
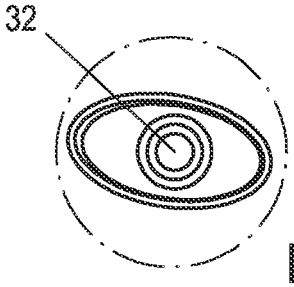
Detail C

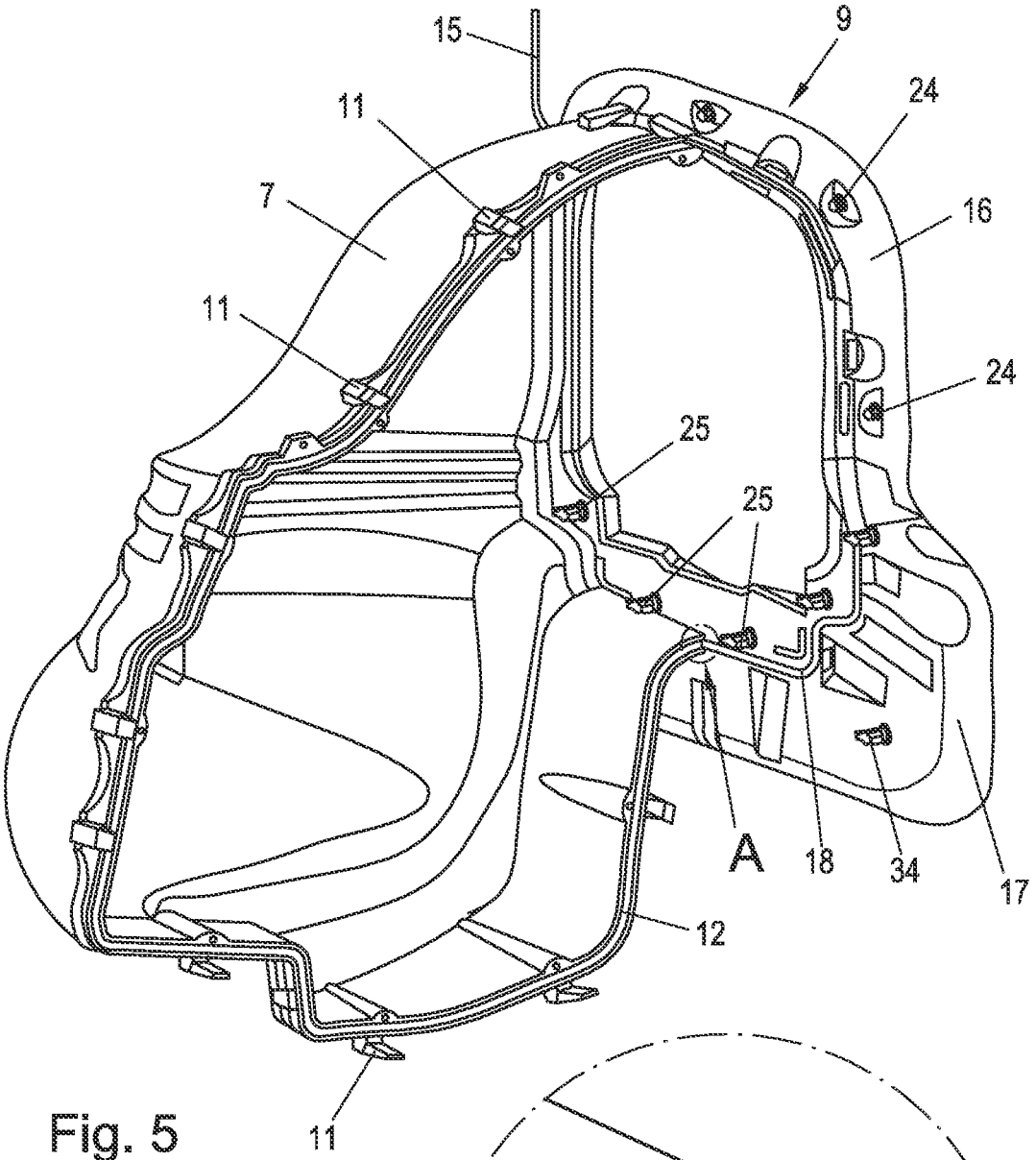
Fig. 5
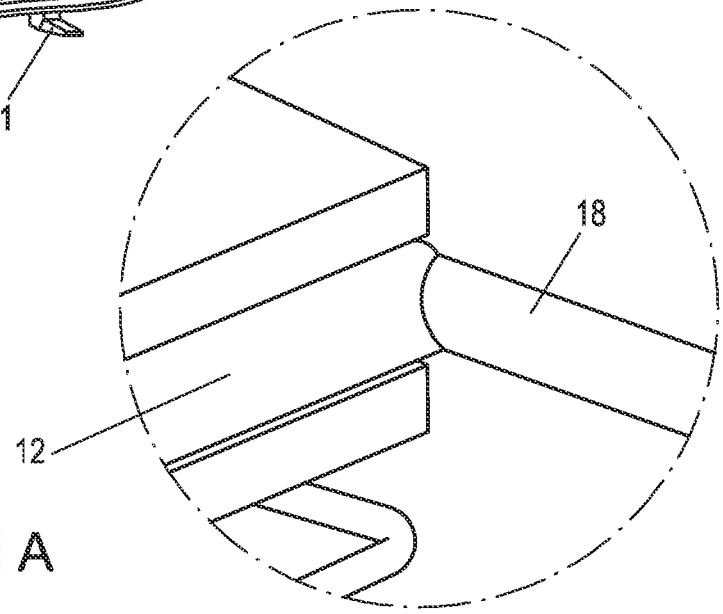
Detail A

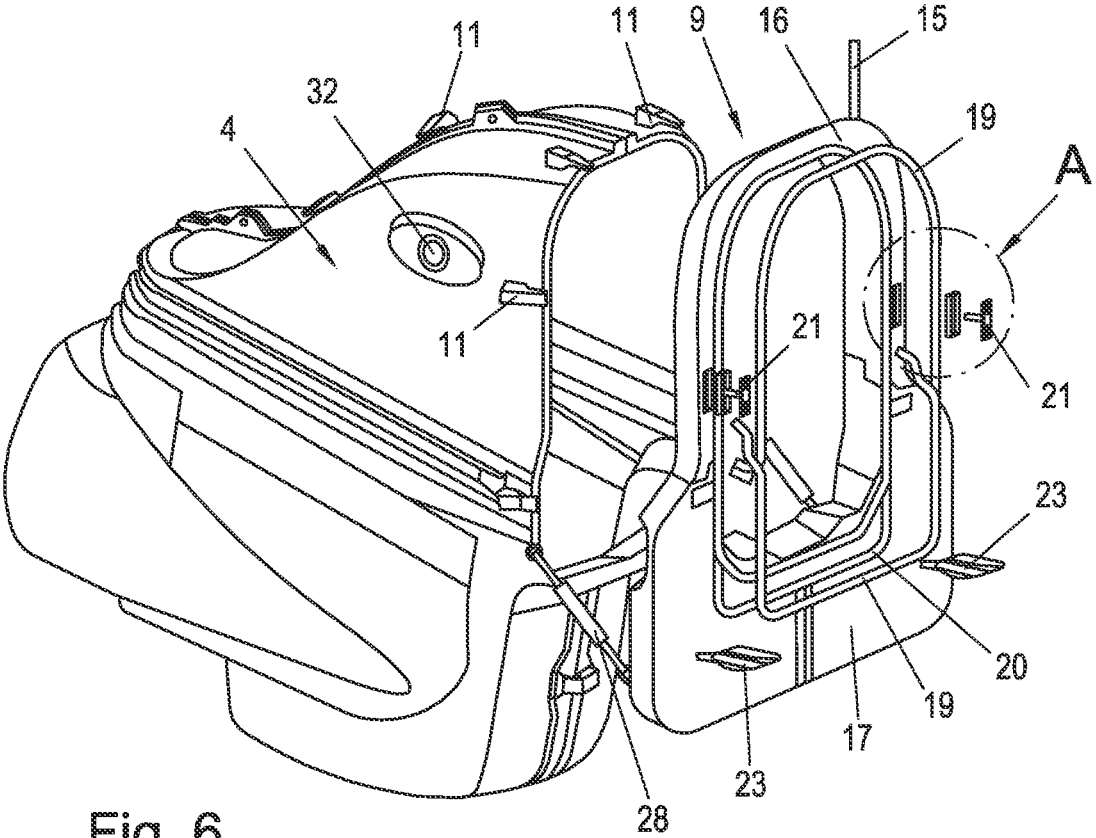
Fig. 6
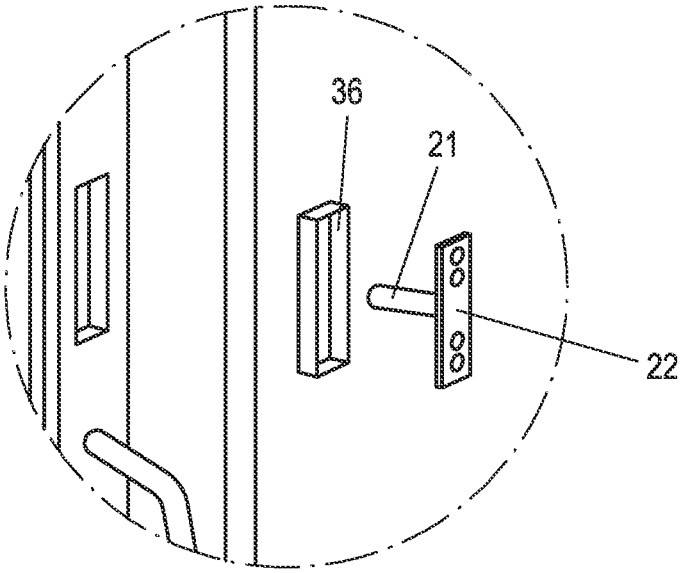
Detail A

LINING FOR VESSEL DRIVES

BACKGROUND OF THE INVENTION

Field of the Invention

The invention relates to a lining for vessel drives.

Description of the Related Art

FR 2 826 929 A1 shows a one-piece protective housing for outboard engines that tightly adjoins a plate attached to the stern (transom) of a boat and in which a pump is provided. The housing is mounted below in pins that are provided on the plate and is secured on the plate above using clasps. The pump makes it possible to pump water out of the housing.

FR 2 743 349 A1 discloses a protective housing for boat sterndrives. The one-piece housing is attached to the stern (transom) of a boat via a sealing arrangement without inflatable elements. A fill opening from which a line leading obliquely downward exits is provided in the housing. The inside space of the housing can be emptied via an additional opening in the wall of the housing by water or gas being suctioned off.

WO 2005/105567 A1 shows a sterndrive housing, which has a cover above. The housing made of GFK (glass-reinforced plastic) is attached directly, i.e., without a separate mounting plate, to the stern (transom) of a boat via a non-inflatable seal and held by tension locks. Water can be removed from the housing using a pump.

WO 2020/094231 A1 discloses a protective arrangement for sterndrives with a one-piece housing, which is mounted directly on the stern (transom) of a boat via a reinforced edge. The interior of the housing is flushed with gas from an external gas source in order to regulate the moisture; to do this, a moisture sensor is provided.

FR 2 977 859 A1 describes and shows a boat drive housing designed as a pleated hose. The pleated hose is attached via a sleeve and counter-sleeve to the stern (transom) of a boat.

US 2006/0089061 A1 relates to a protective housing for outboard engines or the drive part of an inboard engine. The housing consists of two hinged halves that are adjacent in a vertical plane. The housing is not fastened to the boat, but rather simply surrounds the lower part of the screw drive. A similar protective housing is known from DE 43 40 131 A1.

DE 10 2004 004 715 A1 discloses a housing that is attached to the stern (transom) of a boat. A sealing gasket is provided between the housing halves. The housing lies above a lip seal and also directly on the stern (transom) of the boat. DE 10 2004 004 715 A1 does not disclose details on how the housing is to be fastened to the boat.

The objective and purpose of the linings of drives for vessels is to prevent corrosion on the parts of the drive, in particular sterndrives, found outside of the vessel. Moreover, algae and shell growth is to be prevented.

SUMMARY OF THE INVENTION

The object of the invention is to make available a lining of the above-mentioned type that is easy to mount and yet water-tight.

This object is achieved according to the invention with a lining that has the features disclosed below, including preferred and advantageous configurations.

Since an adapter plate is provided in the case of the lining according to the invention, the fastening of the housing halves of the housing of the lining to the vessel is possible in a simple way. In addition, it is advantageous in the invention that the seal between the housing and the adapter plate is an inflatable seal, which ensures good leak tightness.

The adapter plate that is provided in the case of the lining according to the invention has the advantage that the very same housing that consists of the housing halves can be attached to differently-designed vessels on the stern (transom) thereof. This is ensured in the case of an adapter plate that is divided into an upper part and a lower part in particular by an extensive embodiment of the lower part of the adapter plate.

In one embodiment, it is advantageous in the case of the lining according to the invention that quick-release fasteners, such as (lever) tension locks, are provided for connecting the housing halves to one another and/or for connecting the housing to the adapter plate. This embodiment makes possible quick and easy connecting of the housing halves to one another and fastening the housing to the adapter plate and thus to the vessel, without special tools, such as screwdrivers, wrenches, and the like, being necessary.

The valve assigned to the inflatable seal can be designed like a conventional valve for automobile or bicycle tires, so that conventional air pumps, even battery-operated air pumps, can be used in order to inflate the seal.

In one embodiment of the invention, it is provided that the adapter plate is divided into two parts, wherein it is preferred that the lower part of the adapter plate is arranged in a detachable manner on the vessel. The embodiment with a divided adapter plate also facilitates fastening the adapter plate to the vessel in such a way that it surrounds the part of the drive, in particular the sterndrive, lying outside of the vessel.

In one embodiment of the lining according to the invention, it is provided that inside the housing, a pump like a bilge pump is provided. The bilge pump has the advantage that water entering into the interior of the housing can in any case be pumped out. After the housing of the lining is fastened to the adapter plate, water that is located in the housing can also be pumped out by the pump. This has the advantage that the lining can be attached when the vessel is afloat, since then water can be pumped out from the lining. In this case, it can be provided that a non-return valve is assigned to the hose line, through which the bilge pump pumps water out from the interior of the housing, so that water is kept from running back into the housing. The bilge pump can be connected to the power supply system of the vessel or operated with a separate battery system optionally fed with solar power.

In order to ensure an easy mounting of the lining according to the invention without the vessel having to be raised from the water, it can be provided in the case of the lining according to the invention that both housing halves are provided with floats. This makes it possible to soak the two housing halves and then to assemble them and connect them to the adapter plate. This is simply and easily done when, according to one embodiment for connecting the housing to the adapter plate and for connecting the housing halves to one another, quick-release fasteners, such as tension locks with levers, are provided.

A float switch can be assigned to the bilge pump that is provided in any case, so that it is ensured that the bilge pump is only in operation when water is present in the interior of the housing.

In order to simplify the simple and proper mounting of the assembled housing halves on the adapter plate, it can be provided in one embodiment that centering pins (made of stainless steel) and/or strip-like guide elements, such as guide fins, are provided on the side of the adapter plate that faces the housing. The centering pins can engage in corresponding openings in the edge of the housing that faces the adapter plate. The guide elements, which can be fin-like or strip-like, rest on the edge of the housing that faces the adapter plate from the inside and the outside in the case of a housing that is placed on the adapter plate.

One advantage of the lining according to the invention is that it protects the drive, such as a sterndrive, of a vessel (ship/boat/yacht) against algae and shell growth, corrosion, and galvanic currents by salts dissolved in water. Normally, vessel parts located in the underwater area are exposed to shell and algae growth, which occurs more under the action of sunlight. This growth means that the vessel must be raised from the water annually or several times per year at considerable expense in order to remove shell and algae growth and thus to correct resulting damage to the drive, such as a sterndrive, or to its mechanism. Finally, shell and algae growth on a drive (sterndrive) and its screw results in increased fuel consumption, since there is considerably greater driving resistance.

Within the framework of the invention, consideration is given to manufacturing not only the two housing halves, but also the adapter plate—even if the latter is divided into two parts—from plastic, such as glass-reinforced plastic (GFK). This plastic has the advantage that it is dimensionally stable, sea-water-tight, and UV-resistant.

The embodiment of the housing that is made of plastic, such as GFK, also makes it possible to make its outside surfaces smooth, so that growth by shells and/or algae is limited to a great extent.

In a possible, exemplary embodiment of the lining according to the invention, it can be provided that for connecting the housing halves to one another and/or for connecting the housing to the adapter plate, quick-release fasteners, such as (lever) tension locks, are provided.

In a possible, exemplary embodiment of the lining according to the invention, it can be provided that on the side of the adapter plate that faces the vessel, a seal, in particular a seal in the form of a foam O-seal or a plastic cord, preferably made of EPDM (ethylene propylene diene monomer), is provided.

In a possible, exemplary embodiment of the lining according to the invention, it can be provided that the seal between the housing halves is a seal in the form of a plastic cord, in particular made of EPDM.

In a possible, exemplary embodiment of the lining according to the invention, it can be provided that the adapter plate is fastened to the vessel with screw nuts, preferably locking nuts or cap nuts, and that the screw nuts or cap nuts are screwed onto the threaded pins that are fastened, in particular glued, onto the stern of the vessel.

In a possible, exemplary embodiment of the lining according to the invention, it can be provided that the adapter plate is designed essentially ring-like by means of an opening for accommodating the part of the drive lying on the stern of the vessel.

In a possible, exemplary embodiment of the lining according to the invention, it can be provided that the adapter plate is divided and comprises an upper part in the operating position and a lower part in the operating position.

In a possible, exemplary embodiment of the lining according to the invention, it can be provided that the lower part of the adapter plate is detachably attached to the vessel.

In a possible, exemplary embodiment of the lining according to the invention, it can be provided that the seam between the parts of the adapter plate is a step slot.

In a possible, exemplary embodiment of the lining according to the invention, it can be provided that tension devices are provided that are fastened, on the one hand, to the lower area of the adapter plate in the operating position and, on the other hand, to the housing some distance from the adapter plate.

In a possible, exemplary embodiment of the lining according to the invention, it can be provided that the tension devices are turnbuckles.

In a possible, exemplary embodiment of the lining according to the invention, it can be provided that a pump like a bilge pump is provided in the housing.

In a possible, exemplary embodiment of the lining according to the invention, it can be provided that a float switch that is arranged in the interior of the housing is assigned to the pump.

In a possible, exemplary embodiment of the lining according to the invention, it can be provided that a line emptying on the outside of the housing, such as a hose, is connected to the pump.

In a possible, exemplary embodiment of the lining according to the invention, it can be provided that a non-return valve is provided in the line.

In a possible, exemplary embodiment of the lining according to the invention, it can be provided that a valve that is accessible outside of the housing, to which valve a compressed-air source, such as an air pump, can be connected, is assigned to the inflatable seal.

In a possible, exemplary embodiment of the lining according to the invention, it can be provided that centering pins that face openings in the edge of the housing that faces the adapter plate are provided on the side of the adapter plate that faces the housing.

In a possible, exemplary embodiment of the lining according to the invention, it can be provided that guide fins that adjoin the edge of the housing that faces the adapter plate on the inside and outside are provided on the side of the adapter plate that faces the housing.

In a possible, exemplary embodiment of the lining according to the invention, it can be provided that the housing is made of plastic, preferably a glass-fiber-reinforced plastic, with a smooth exterior.

In a possible, exemplary embodiment of the lining according to the invention, it can be provided that screw nuts are screwed onto threaded bolts, which are screwed into anchor plates fastened to the vessel and extend through the lower part of the adapter plate.

In a possible, exemplary embodiment of the lining according to the invention, it can be provided that the anchor plates are fastened, in particular glued, to the bottom of the vessel.

BRIEF DESCRIPTION OF THE DRAWINGS

Additional details and features as well as advantages of the lining according to the invention are given in the description below of an embodiment based on the drawings. Here:

FIG. 4 shows in a side view a complete lining on the adapter plate and details A to C, FIG. 5 shows in an oblique view the left housing half with detail A, and FIG. 6 shows in an oblique view the complete housing of the lining with adapter plate and detail A.

DESCRIPTION OF THE PREFERRED EMBODIMENTS

Figure 1:
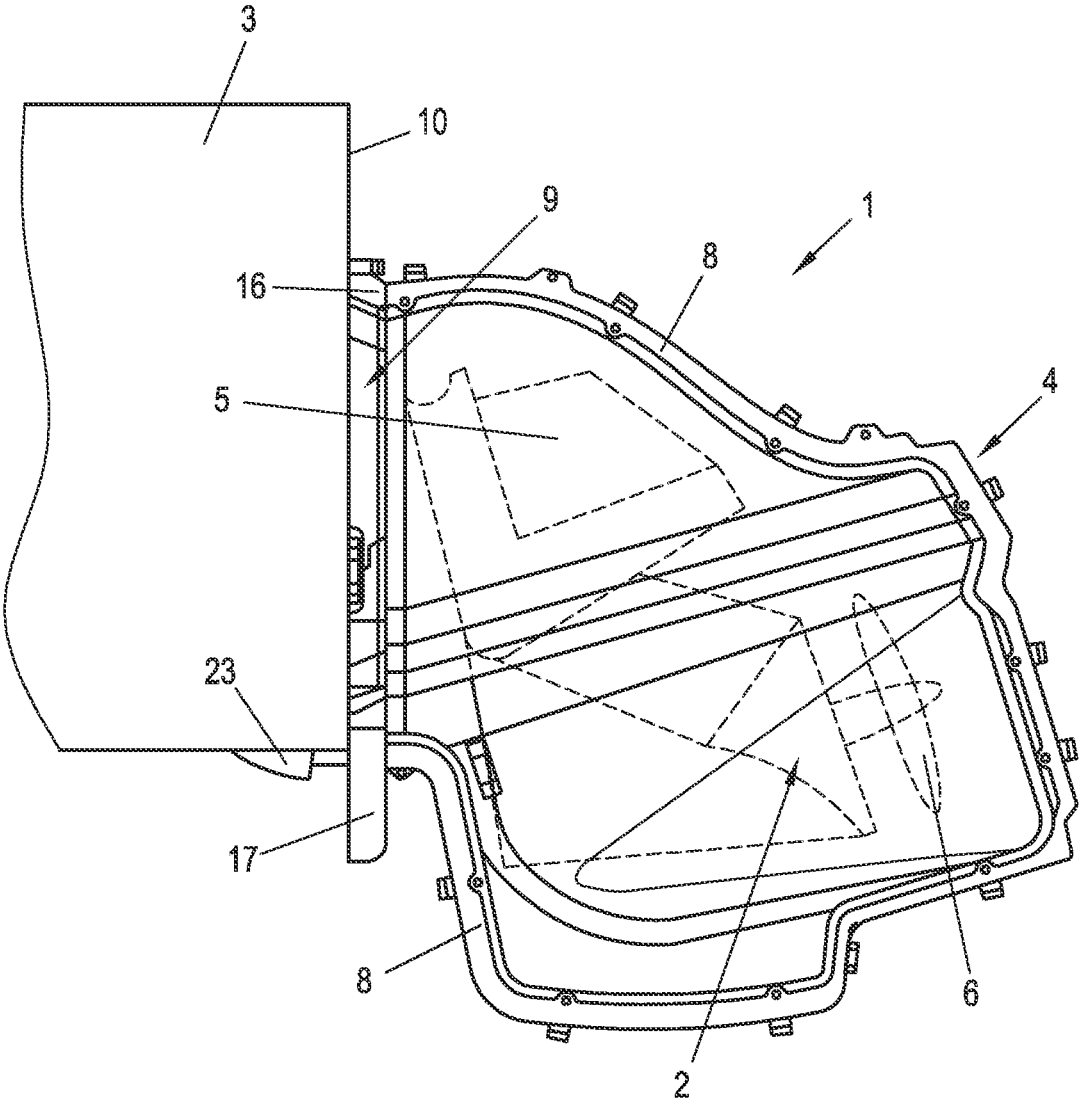
FIG. 1 shows a sterndrive arranged in a lining.

A lining 1 according to the invention for sterndrives 2 of vessels 3 comprises a housing 4, in which the gear system 5 and the ship propeller 6 of the sterndrive 2 are accommodated.

Housing halves 7 and 8 of the housing 4—only one of the housing halves 7, 8, namely the right (starboard-side) housing half 8, is depicted in FIG. 1—are fastened to an adapter plate 9, which for its part is mounted on the aft ship's side 10 of the vessel 3. In this case, the marine engine is located inside the vessel 3 and essentially faces the sterndrive 2 shown in FIG. 1.

Figure 2:
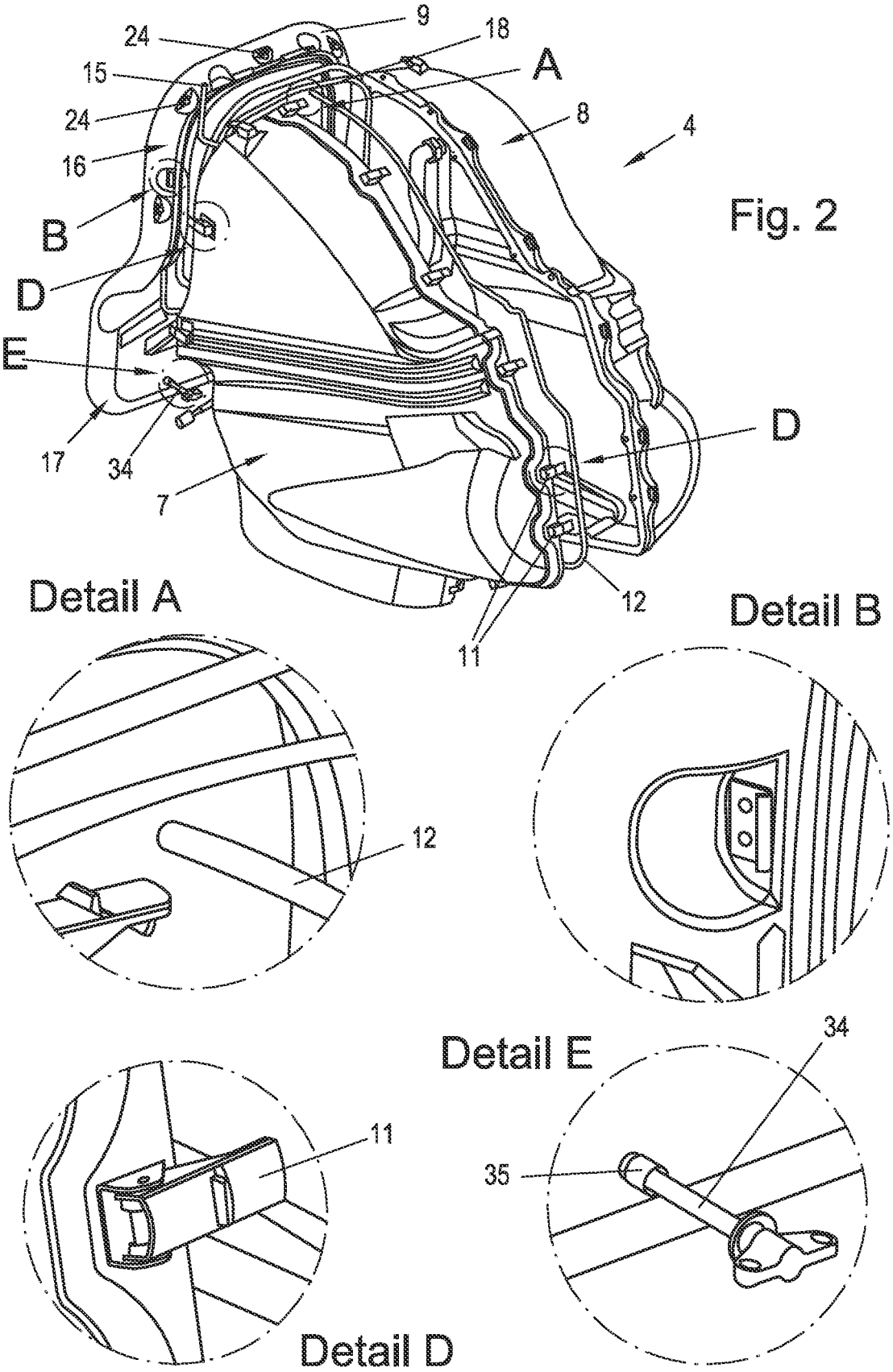
FIG. 2 shows in an oblique view the lining in an exploded depiction with details A to E.

It can be seen from FIG. 2 that the lining 1 according to the invention has the housing 4 that consists of the housing halves 7 and 8 (right and left housing halves), which are fastened in assembled form to the adapter plate 9. The adapter plate 9 for its part is mounted on the ship's side 10.

For connecting the housing halves 7 and 8 to one another, (lever) quick-release tension locks 11 are provided, which put pressure on the housing halves 7 and 8 and hold them together. A seal 12 is arranged between the two housing halves 7 and 8, so that the housing 4, consisting of the housing halves 7 and 8, is water-tight when the housing halves 7 and 8 are connected to one another. The seal 12 between the housing halves 7 and 8 can be designed as a sealing profile made of plastic, such as neoprene or EPDM-foam rubber. In this case, it is preferred that the seal 12 be arranged, in particular cemented, in a groove in one of the housing halves 7 or 8. The groove for the seal 12 is provided in the edge of the housing half 7 or 8 that faces the other housing half 7 or 8.

The fastening of the housing halves 7 and 8, connected to one another to form the housing 4, and of the adapter plate 9 is done using (lever) quick-release tension locks 11, as is shown in the details B and D of FIG. 2.

Figure 3:
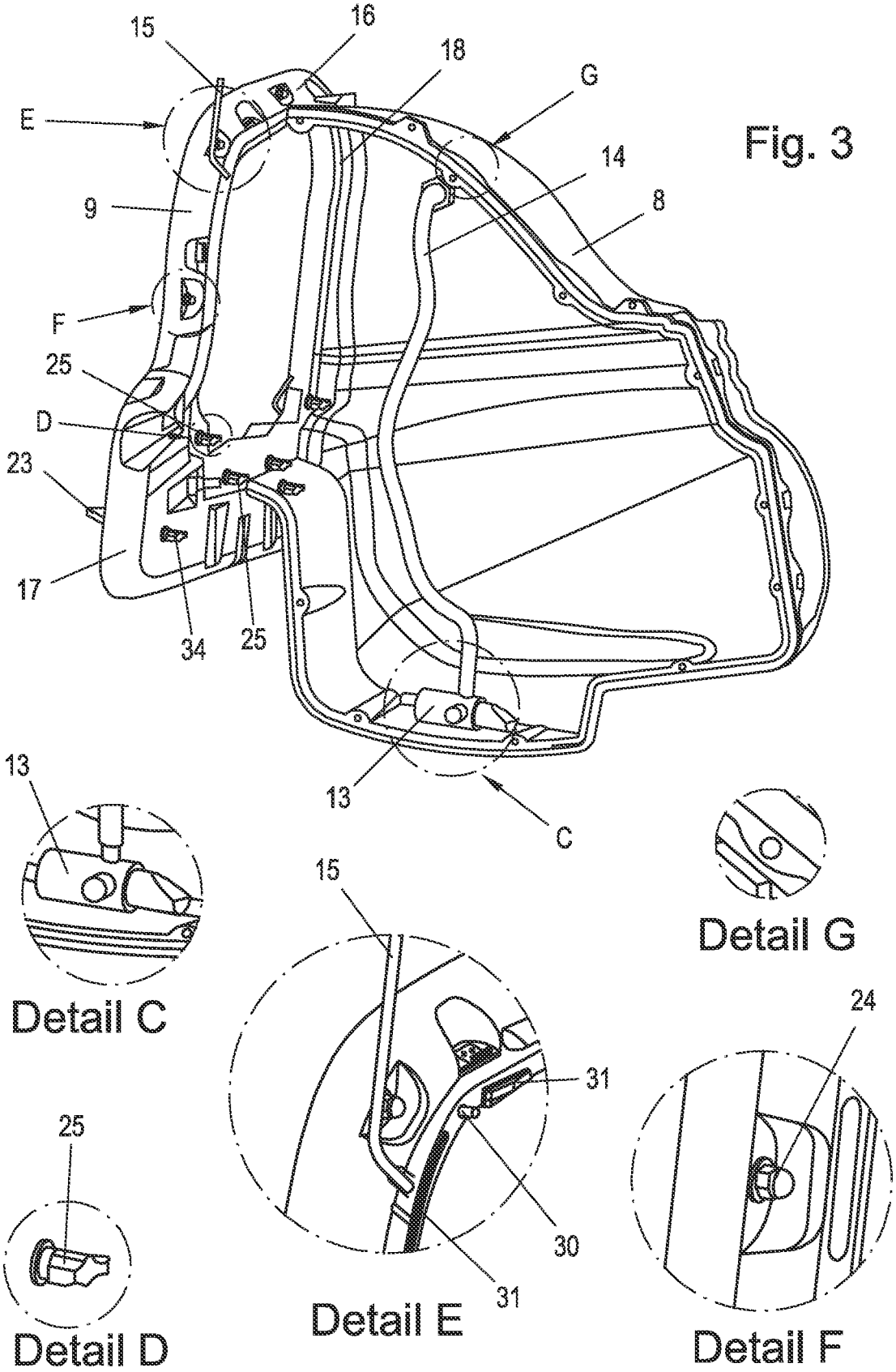
FIG. 3 shows in an oblique view a right housing half of the lining with adapter plate and details C to G.

FIG. 3 shows the right (starboard-side) housing half 8, in which a bilge pump 13 (cf. detail C in FIG. 3) is arranged. From the bilge pump 13, which is arranged in the lower area of the housing 4, a line 14 leads upward to an outlet 32 (detail C in FIG. 4), which is provided in the upper area of the housing 4. A non-return valve is provided in the line 14.

The adapter plate 9 consists of an upper part 16 and a lower extensive part 17, both of which are connected to the ship's side 10. The seam between the parts 16 and 17 of the adapter plate 9 is designed as a step slot.

A seal 18, which is designed as an inflatable seal 18, is provided between the housing halves 7 and 8, connected to one another to form the housing 4, and the adapter plate 9. So that the seal 18 can be inflated between the housing 4 and the adapter plate 9, a valve is provided that is arranged outside of the housing 4. The valve can be designed like a valve for a bicycle or automobile tire. The valve is arranged at the free end of a feed line 15 that is above and outside of the housing 4 of the lining 1 according to the invention (cf. FIG. 3, detail E), which feed line leads to the seal 18. Thus, the valve is also easily accessible in the case of a lining 1 mounted on a vessel 3.

The adapter plate 9, which consists of the upper part 16 and the lower part 17, is fastened to the ship's side 10 (ship's transom). In this case, it is provided that the upper part 16 of the adapter plate 9 always remains mounted on the hull. However, the lower part 17 of the adapter plate 9 is only mounted on the hull when the housing 4 of the lining 1 is to be attached.

In order to seal the adapter plate 9, consisting of the upper and lower parts 16 and 17, relative to the ship (ship's transom), a seal 19 (neoprene or EPDM-foam rubber) is provided between the adapter plate 9 and the ship's side 10, which seal is glued into a groove in the ship's-side side of the adapter plate 9.

The fastening of the adapter plate 9 to the ship's side 10 is done via threaded pins 21, which are glued to the ship's side 10. For example, five threaded pins 21 are provided for the upper part 16 of the adapter plate 9 (cf. FIG. 5), and, for example, six threaded pins 21 are provided for the lower part 17 of the adapter plate 9. As detail A of FIG. 6 shows, the threaded pins 21 are provided with perforated base plates 22 that are fastened, in particular glued, to the aft ship's side, so that an adequate adhesive surface is ensured. In order to cover any traces of adhesive in the area of the anchor plates 23 of the threaded pins 21, the anchor plates 23 can be covered by hoods 36 (cf. FIG. 6, detail A).

The upper part 16 of the adapter plate 9 is fastened using cap nuts 24, which are screwed onto the threaded pins 21 (cf. detail F of FIG. 3).

The lower part 17 of the adapter plate 9 is attached by means of screw nuts, preferably locking nuts (wing nuts) 25 (cf. FIG. 3, detail D), which are screwed onto threaded bolts 21. For fastening the lower part 17 of the adapter plate 9, the locking nuts 25 can be attached using chains to the lower part 17 of the adapter plate 9 to keep them from getting lost.

Buoyant forces have a/an (considerable) effect on the housing 4 of the lining 1 according to the invention when the latter is empty, i.e., no water is contained in it. These buoyant forces put pressure on the lower quick-release clamps 11, with which the housing halves 7 and 8 are fastened to the adapter plate 9. To accommodate this, rings 27 are provided on the lower part 17 of the adapter plate 9, in which rings tension devices, such as turnbuckles 28 (cf. FIG. 4, detail D), are mounted. The other ends of the turnbuckles 28 are secured on the housing halves 7 and 8 some distance from the adapter plate 9. Thus, the quick-release clamps 11, which secure the housing 4 of the lining 1 to the adapter plate 9, are also relieved of pressure in the lower area of the lining 1. In order to deflect forces acting on the lower part 17 of the adapter plate 9 from the turnbuckles 28, anchor plates 23 that carry threaded bolts 33 are fastened, e.g., glued, to the bottom of the vessel 3. Screw nuts 35 provided with handles 34 are screwed onto the threaded bolts 33, which screw nuts in addition attach the lower part 17 of the anchor plate 23 to the vessel 3 (cf. FIG. 4, detail A, FIG. 2, detail E, and FIG. 5).

On the side of the adapter plate 9 that faces the housing 4, centering pins 30 (cf. FIG. 3, detail E) are also provided, so that the housing 4 can easily be correctly oriented to the adapter plate 9. In addition, the correct orientation of the housing 4, consisting of the two housing halves 7 and 8, is ensured by guide fins 31 on the side of the adapter plate 9 that faces the housing 4 (cf. detail E of FIG. 3). The guide fins 31 adjoin the edge of the housing 4 that faces the adapter plate 9 on the inside and outside.

Due to the lining 1 according to the invention for drives, such as sterndrives 2, of vessels 3, the latter are reliably protected against algae and shell growth and corrosion and galvanic currents by salts dissolved in water.

In the case of the lining 1 according to the invention, it is an advantage that a secure seal against seepage is ensured by the seals 12 and 18 between the housing halves 7 and 8, on the one hand, and the housing 4 and the adapter plate 9, on the other hand.

The mounting of the housing 4 on the adapter plate 9 and also the connecting of the housing halves 7 and 8 to one another to form the housing 4 is done using quick-release fasteners 11 (made of stainless steel), so that special tools are not necessary.

In the case of an embodiment of the lining 1, it is advantageous that in the case of an unexpected seepage in the lining 1, the bilge pump 13 is provided, which immediately pumps out the water that has infiltrated (automatically controlled by a float switch) from the lining 1. The bilge pump 13 can be connected to the power supply system of the ship or to a battery.

The bilge pump 13 that is mounted securely in the right housing half 8 in its lower area also has the advantage that the lining 1 according to the invention can be attached when the vessel 3 is still afloat, i.e., the drive, such as sterndrive 2, is at least partially below the water level, since water that is present in the lining 1 can be pumped out from the lining 1 using the bilge pump 13, although the housing 4 that forms the lining is mounted securely on the vessel 3. In summary, an embodiment of the invention can be described as follows:

A lining 1 for drives, such as sterndrives 2, of vessels 3 has a housing 4 that consists of two housing halves 7 and 8. The housing 4 is secured on an adapter plate 9 that is fastened to the vessel 3. A seal 12 is provided between the housing halves 7 and 8. A seal 18 that can be expanded by compressed air is arranged between the housing 4 and the adapter plate 9. The housing halves 7 and 8 are connected to one another by means of (lever) tension locks 11. The housing 4 is secured on the adapter plate 9 by means of (lever) tension locks 11. In the housing 4, a float-controlled bilge pump 13, from which a line 14 leads to an opening provided in the upper area of the housing 4, is provided below.

The invention claimed is:

1. Lining for drives of vessels, comprising a housing, which surrounds the part of the drive lying outside of the vessel and which has two adjoining housing halves along a plane that is essentially vertical in the operating position, wherein a seal is provided between the housing halves, and wherein the housing is designed for fastening to the stern of the vessel, wherein an adapter plate that is detachably connected to the housing and that is to be mounted on the stern of the vessel is provided, and wherein an inflatable seal is provided between the housing and the adapter plate.

2. The lining according to claim 1, wherein for connecting the housing halves to one another and/or for connecting the housing to the adapter plate, quick-release fasteners are provided.

3. The lining according to claim 1, wherein on the side of the adapter plate (9) to be turning toward the vessel, a seal is provided.

4. The lining according to claim 1, wherein the seal between the housing halves is a seal in the form of a plastic cord.

5. The lining according to claim 1, wherein the adapter plate is fastened to the vessel with screw nuts or cap nuts, and wherein the screw nuts or cap nuts are screwed onto threaded pins that are fastened to the stern of the vessel.

6. The lining according to claim 1, wherein the adapter plate is designed essentially ring-like by means of an opening for accommodating the part of the drive lying on the stern of the vessel.

7. The lining according to claim 1, wherein the adapter plate is divided and comprises an upper part in the operating position and a lower part in the operating position.

8. The lining according to claim 7, wherein the lower part of the adapter plate is detachably attached to the vessel.

9. The lining according to claim 7, wherein the seam between the parts of the adapter plate is a step slot.

10. The lining according to claim 1, wherein tension devices are provided that are fastened both to the lower area of the adapter plate in the operating position, and also to the housing some distance from the adapter plate.

11. The lining according to claim 10, wherein the tension devices are turnbuckles.

12. The lining according to claim 1, wherein a pump like a bilge pump is provided in the housing.

13. The lining according to claim 12, wherein a float switch that is arranged in the interior of the housing is assigned to the pump.

14. The lining according to claim 12, wherein a line emptying on the outside of the housing is connected to the pump.

15. The lining according to claim 14, wherein a non-return valve is provided in the line.

16. The lining according to claim 1, wherein a valve that is accessible outside of the housing, to which valve a compressed-air source can be connected, is assigned to the inflatable seal.

17. The lining according to claim 1, wherein centering pins that face openings in the edge of the housing that faces the adapter plate are provided on the side of the adapter plate that faces the housing.

18. The lining according to claim 1, wherein guide fins that adjoin the edge of the housing that faces the adapter plate on the inside and outside are provided on the side of the adapter plate that faces the housing.

19. The lining according to claim 1, wherein the housing is made of plastic, with a smooth exterior.

20. The lining according to claim 5, wherein screw nuts are screwed onto threaded bolts, which are screwed into anchor plates fastened to the vessel and extend through the lower part of the adapter plate.

21. The lining according to claim 20, wherein the anchor plates are fastened to the bottom of the vessel.

* * * * *